United States Patent [19]

Stott

[11] 3,964,776

[45] June 22, 1976

[54] LIFT BAIL ASSEMBLY FOR LOG TRUCK TRAILERS

[76] Inventor: Robert C. Stott, 3609 E. 17th St., Eugene, Oreg. 97403

[22] Filed: Jan. 6, 1975

[21] Appl. No.: 538,712

[52] U.S. Cl. ..... 294/74; 294/82 AH; 294/86 R

[51] Int. Cl.[2] ..... B66C 1/20

[58] Field of Search ..... 294/67 R, 67 E, 67 EA, 294/74, 75, 82 AH, 78 R, 86 R; 105/160, 160.5; 280/179 A, 404, 480

[56] References Cited

UNITED STATES PATENTS

| | | | |
|---|---|---|---|
| 1,720,069 | 7/1929 | Yeaton | 294/74 |
| 1,941,582 | 1/1934 | Schroeder | 294/74 X |
| 2,903,291 | 9/1959 | Barthule | 294/74 |
| 3,240,526 | 3/1966 | Schopf et al. | 294/74 |
| 3,317,233 | 5/1967 | Black | 294/74 |
| 3,863,973 | 2/1975 | Ross | 294/74 |

*Primary Examiner*—Evon C. Blunk
*Assistant Examiner*—Johnny D. Cherry
*Attorney, Agent, or Firm*—James D. Givnan, Jr.

[57] ABSTRACT

A lift bail assembly is disclosed in attachment to a log truck trailer to receive a lifting instrumentality for loading of the unloaded trailer onto the log truck tractor chassis. The assembly includes a length of wire rope shielded by a curved tubular member with each end of the wire rope being fitted with ferrules. A pair of fittings are detachably mounted on an upright, trailer mounted plate with each fitting defining a downwardly opening socket within which is received a ferrule. Upon fitting detachment from the upright plate the wire rope and its attached ferrules may be conveniently removed permitting replacement by the driver of a new wire rope and ferrule combination.

6 Claims, 4 Drawing Figures

LIFT BAIL ASSEMBLY FOR LOG TRUCK TRAILERS

BACKGROUND OF THE INVENTION

The present invention concerns an attachment for log truck trailers to provide a flexible bail engageable by a log grapple or other lifting instrumentality to facilitate lifting the unloaded trailer onto the truck chassis.

A well established practice in the logging industry is the loading of an empty log truck trailer into place on the log truck chassis for a return trip to the log loading site. In the past, log trailers have been provided with grapple engaged means to accomplish such lifting. Grapple engagement with the wire often results in early fraying of the wire rope which terminates further use of the wire rope for reasons of safety. As presently used, the wire rope is fitted with permanently attached clevises requiring the frayed wire rope segment and attached clevises to be returned to a shop whereat wire rope substitution may be accomplished, the wire rope ends being secured within the clevises by means of a costly and time consuming "leading in" process. Until such time as the trailer is re-equipped with the new lift bail, it is unusable for log transport. While a replacement lift bail may be carried in the truck such is not done in view of their high unit cost.

SUMMARY OF THE INVENTION

The present invention is embodied within a lift bail comprising a length of wire rope fitted at its ends with ferrules each of the latter being detachably engageable with a trailer attached fitting the latter mounted in a manner preventing accidental ferrule release. Intermediate the wire rope ferrules is a curved sleeve which isolates the wire rope from grapple contact. The log truck trailer is equipped with a plate member, lengthwise oriented to the centerline, with openings spaced along said member for selective attachment of each of the pair of fittings. By selective fitting attachment to the plate, fore and aft of the trailer center of gravity, the trailer may be lifted in a tipped attitude coinciding with its attitude when in place on the truck chassis. Each fitting defines a downwardly opening socket for inserted reception of a ferrule with a lateral opening in the socket permitting wire rope passage. Leg portions of the fitting are mounted astride the trailer mounted upright plate with said plate blocking downward passage of the ferrule until such time as the fitting is removed from the plate.

Important objects of the invention include the provision of: a replaceable lift bail for log truck trailers wherein the bail comprises a length of wire rope permanently fitted at its ends with ferrules the bail being removably mounted within trailer mounted fittings and readily disengageable therefrom permitting convenient, low cost bail replacement; a lift bail arrangement wherein trailer attached fittings define sockets open along one of their sides to receive the wire rope bail permitting convenient separation of the bail and its ferrules from their respective fittings; a detachable lift bail providing a replaceable wire rope bail of low cost enabling the truck operator to carry a spare bail enabling replacement in the field to avoid truck down time; a lift bail assembly including trailer mounted fittings attached to the trailer in a manner confining each of the wire rope ferrules against accidental separation of the fitting; a lift bail including a curved metal sleeve in place on the wire rope to guard same against damaging contact with powered log grapples during trailer lifting.

DESCRIPTION OF THE PREFERRED EMBODIMENT

Figure 1:
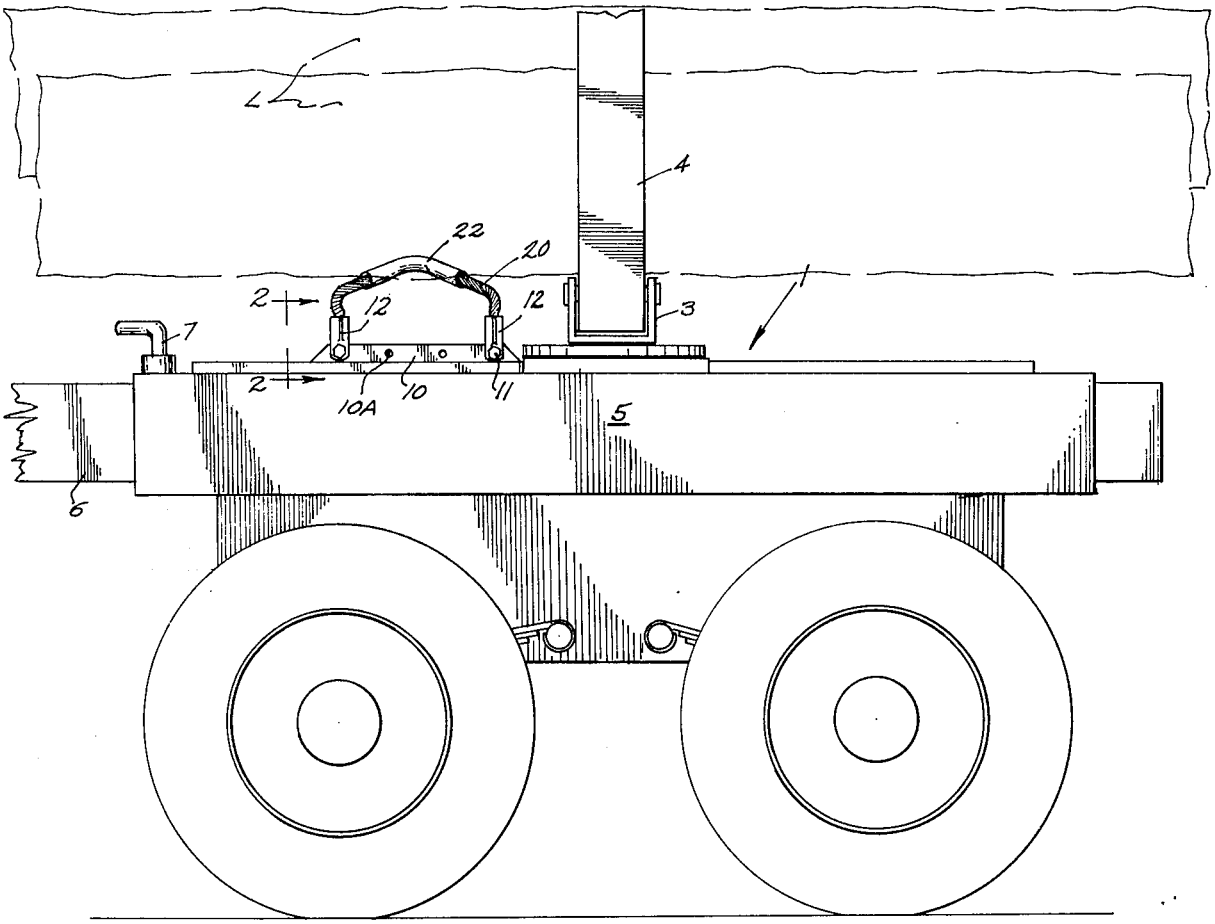
FIG. 1 is a side elevational view of a conventional log truck trailer having the present lift bail in place thereon.

With continuing reference to the accompanying drawing wherein applied reference numerals indicate parts similarly identified in the following specification, the reference numeral 1 indicates generally a log truck trailer supporting the trailing ends of a stack of logs L confined within a U-shaped bunk structure comprising a bunk at 3 and bunk stakes at 4 with the bunk structure coupled to a trailer chassis at 5 in a manner permitting bunk movement about a vertical axis facilitating turning during highway travel. A trailer reach at 6 extends forwardly from chassis 5 for coupled attachment to the log truck tractor. Trailer chassis 5 is positionable fore and aft with respect to the reach and secured thereto by means of locking means at 7. The foregoing is intended to be descriptive of a conventional log truck trailer with minor variations being found in such trailers which are of little or no consequence to the present invention.

With attention now to the present invention, an elongate lift plate at 10 is in welded securement to the trailer chassis 5 desirably along the trailer centerline. Said lift plate defines multiple openings at 10A each of which is adapted to receive a threaded fastener assembly at 11 for attachment of a fitting 12.

Figure 4:
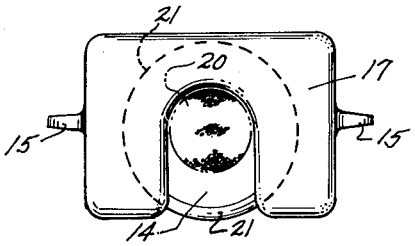
FIG. 4 is a plan view of FIG. 2.
Figure 2:
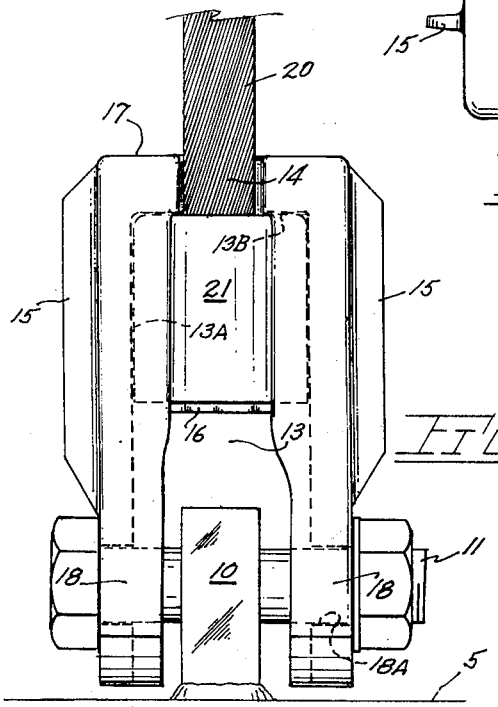
FIG. 2 is an elevational view taken along line 2—2 of FIG. 1 showing a front elevation of a trailer attached fitting and bail segment.
Figure 3:
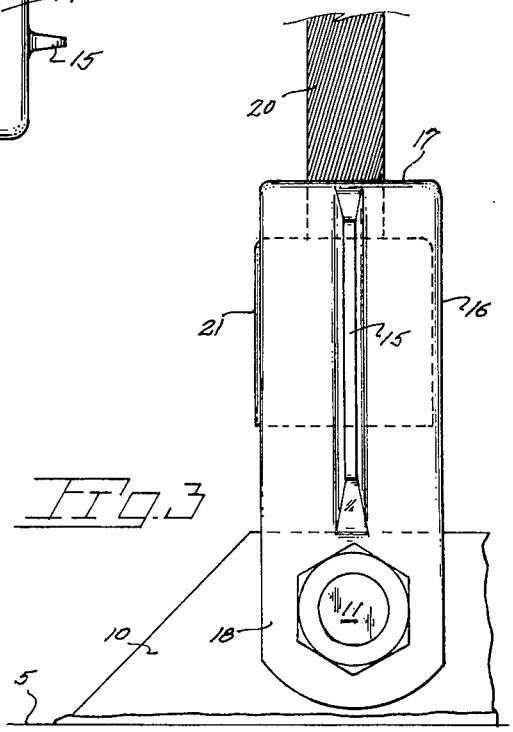
FIG. 3 is an elevational view of the right hand side of FIG. 2.

With particular attention to fitting 12, the same is preferably a casting formed with interior sidewalls 13A and an end wall 13B to define a ferrule receiving, downwardly opening socket 13. In communication with the fitting defined socket 13 is a laterally extending opening 14 at the fittings upper end through which wire rope may pass during rope removal and substitution. Reinforcing fitting 12 are a pair of side flanges 15. As viewed in FIGS. 3 and 4, each fitting further includes a backwall 16 extending approximately midway of the fittings length and a top wall 17 the latter defining transverse opening 14. The fittings terminate downwardly in leg portions 18 which straddle lift plate 10 and receive fastener assembly 11 within leg apertures 18A.

With attention to FIG. 1, a replaceable lift bail comprises a segment of wire rope 20 fitted at its ends with ferrules 21 which are swaged onto the wire rope ends. Each ferrule is in seated engagement within the upper end of a fitting socket 13 with the wire rope passing through transverse opening 14.

A protective sleeve at 22 is of curved configuration and receives the grapple or other lifting instrumentality thereby isolating the wire rope from direct damaging contact with the grapple. As the flexible wire rope is inherently of curved configuration when in place, sleeve 22 will be retained at the apex of the rope curvature.

In use, the wire rope will flex or yield upon log contact with a log being loaded. After unloading of the logs, normally done with a hydraulically powered grapple, the grapple is engaged with the lift bail to load the uncoupled trailer into place on the truck chassis. The lift bail by reason of the wire ropes semi-rigid nature is at all times at least somewhat elevated from trailer chassis 5 to enable insertion of the grapple ends below sleeve 22. To accomplish replacement, the truck operator needs only to remove fastener assemblies 11 from the two fittings, separate said fittings from trailer mounted plate 10 and subsequently disengage ferrules 21 from each fitting. A second lift bail, normally kept on hand in the truck cab, is manually attached to the fittings. Such replacement entails only the use of a wrench or wrenches and may be performed in the field with little or no "down time" to truck operation.

Depending on trailer style, a pair of trailer mounted plates may be used with each oppositely spaced fore and aft from the log bunk 3. Lift bail 20 extends over the bunk and is yieldable to prevent damaging confinement between the loaded logs and the bunk.

While I have shown but one embodiment of the invention it will be apparent to those skilled in the art that the invention may be embodied still otherwise without departing from the spirit and scope of the invention.

Having thus described the invention what is desired to be secured under a Letters Patent is:

1. A lift bail assembly for attachment to a log truck trailer fore and aft of the trailer center of gravity for lifting same, and lift bail assembly comprising, a replaceable bail including enlarged means secured to each end of the bail, a pair of unitary fittings adapted to be detachably mounted in a spaced apart manner on the trailer fore and aft of the trailer center of gravity, each fitting including socket defining side walls and a top wall, said side walls and said top wall defining transversely directed openings in communication with the socket for bail passage permitting bail separation from the fitting, said openings of lesser width than said socket, each fitting adapted for attachment at its lower end to the trailer in a manner blocking the socket lower end thereby preventing bail separation in a downward direction from the fitting, and said replaceable bail being disengageable without the aid of tools from each of said fittings upon fitting removal from the trailer.

2. The lift bail assembly as claimed in claim 1 additionally including rigid protective means in place on the replaceable bail, said rigid protective means of tubular, curved configuration.

3. The lift bail assembly as claimed in claim 1 wherein the fitting side walls terminate downwardly in leg portions positionable astride an upright plate permanently mounted on the trailer.

4. In combination with a lift bail mounted on a log truck trailer to receive a lifting instrumentality for lifting of the unloaded trailer onto the log truck for highway travel, the improvement comprising, a fitting for reception of a ferrule secured to a lift bail end, said fitting including side walls and a top wall the latter defining the upper terminus of a fitting socket, said side walls and said top wall defining transversely directed openings each in communication with and of lesser width than the socket, said side walls terminating downwardly in leg portions apertured to receive fastening means insertable therethrough and through a lift plate disposed between said leg portions and secured to the log truck trailer whereby the lift bail ferrule is confined within the fitting defined socket until detachment of the fitting from the lift plate whereupon the ferrule may be removed downwardly past said leg portions for bail replacement purposes with the lift bail removed via said openings.

5. The improvement as claimed in claim 4 wherein said fitting has internal walls of arcuate section to confine the ferrule against lateral movement.

6. The improvement as claimed in claim 5 wherein the fitting leg portions are reinforced by lengthwise extending flanges.

* * * * *